US005240336A

United States Patent [19]

Shiraishi et al.

[11] Patent Number: 5,240,336

[45] Date of Patent: Aug. 31, 1993

[54] DOT MATRIX PRINTER WITH SUPPRESSED PRINTING NOISES

[75] Inventors: Tadashi Shiraishi; Yutaka Miyazono, both of Kasuga; Seiji Kimura, Tamana; Syogo Horinouchi; Yuuji Terashima, both of Fukuoka; Takashi Haruguchi, Kasuga; Kazumi Ootubo, Kurume, all of Japan

[73] Assignee: Matsushita Electric Industrial Co., Ltd., Osaka, Japan

[21] Appl. No.: 688,680

[22] Filed: Apr. 22, 1991

[30] Foreign Application Priority Data

Apr. 27, 1990 [JP] Japan ..... 2-113329
Jun. 11, 1990 [JP] Japan ..... 2-151907

[51] Int. Cl.[5] ..... B41J 29/10

[52] U.S. Cl. ..... 400/693; 400/642; 400/121; 400/689

[58] Field of Search ..... 400/121, 642, 636.2, 400/689, 690, 1, 690.4, 691, 693

[56] References Cited

U.S. PATENT DOCUMENTS 4,059,183 11/1977 Hoskins ..... 400/121
5,026,186 6/1991 Hasegawa ..... 400/691

FOREIGN PATENT DOCUMENTS 0224737 6/1987 European Pat. Off. ..... 400/691
56-44461 10/1981 Japan ..... 400/121
59-81182 5/1984 Japan ..... 400/691
63466 4/1986 Japan ..... 400/691
62-122775 6/1987 Japan ..... 400/690
62-201281 9/1987 Japan ..... 400/690

*Primary Examiner*—David A. Wiecking
*Assistant Examiner*—Steven S. Kelley
*Attorney, Agent, or Firm*—Stevens, Davis, Miller & Mosher

[57] ABSTRACT

A dot matrix printer of a dispersion printing type in which a printing noise is suppressed and dots arranged in longitudinal rows are driven while shifting the timing for every print wire dot. The present dot matrix printer is characterized by a construction in which respective print wires are driven at different timings within one pitch, and a space around a print head is surrounded by a housing and a platen, and a sound generated in the space is transmitted outside through walls. Further, the present dot matrix printer is characterized in that there is provided a memory storing printing intervals among the whole dots and print head conduction time, and the print head is driven in accordance with information read out of said memory in order to correct deviation of dot rows arranged in a longitudinal direction of the print head from perpendicularity. According to the present dot matrix printer, since the print head is driven at a high frequency by an inexpensive control unit, the noise frequency at printing with the print head becomes high, and the generated noise is transmitted outside through walls. Therefore, attenuation in a high-pitched tone compass is large through walls, thus exhibiting an effect that the operation sound of the printer leaking outside is made smaller.

6 Claims, 21 Drawing Sheets

TRANSMISSION LOSS $TL = L_I - L_O$

DOT MATRIX PRINTER WITH SUPPRESSED PRINTING NOISES

BACKGROUND OF THE INVENTION

Field of the Invention

The present invention relates to a dot matrix printer of a dispersion printing system in which printing dots arranged in longitudinal lines are driven while shifting a timing for every dot, and more particularly to a printer in which noises generated in printing are suppressed.

Description of the Related Arts

A printer using a dispersion print head in which printing dots are arranged with a gradient on the print head and drive signals corresponding to the gradient of these dots are supplied so as to perform printing has become prevailing in the field of dot matrix printers. This is due to demands for avoidance of generated noises, necessity for a large capacity power source and magnetic interference while magnetic force is employed, because of the fact that a former print head strikes at the same time, and for packaging at a high density and so on. The above-mentioned conventional dot matrix printer will be described hereafter with reference to FIG. 18 to FIG. 24.

FIG. 18 is a sectional view of a printer according to prior art when a continuous form is used, FIG. 19 is a sectional view of the printer when a cutform is used, and FIG. 20 is a perspective view of the printer.

FIG. 21A shows a dot pattern of a formerly used 24-pin wire dot head, FIG. 21B shows a dot pattern of a dispersion print head in which dots are arranged with a gradient, and FIG. 21C shows another example of a dot pattern of the dispersion print head.

In FIG. 18 through FIG. 20, a numeral 101 denotes a housing consisting of an upper housing 101*c* and a lower housing 101*d* and in which an opening portion 101*e* is formed at a part of the upper housing, 112 denotes a carriage and 102 denotes a print head mounted on the carriage 112 in which printing wires are arranged alternately in two rows as shown in FIG. 21A for instance so that mutual printing wires do not overlap one another at horizontal positions. 103 denotes a cylindrical platen, 104 denotes a tractor feeder which conveys continuous forms to the platen 103, and 105 denotes a paper stand which is laid down horizontally when continuous forms are used and is set up when cutforms are used by which the upper opening portion 101*e* of the housing 101 is separated into a paper feed port 101*a* for continuous forms and a conveying port 101*b* performing feed and discharge of cutforms and discharge of continuous forms. 106 denotes a paper separator which is located above the platen 103 for dividing into a passage when forms are inserted from the conveying port 101*b* to the platen 103 and a passage when forms are discharged from the platen 103, and 107 denotes a front cover installed above the print head 102. Furthermore, a paper guide 108, a paper presser plate 109, a paper holder 110 and a paper presser roller 111 are arranged around the platen 103 for carrying forms smoothly.

A device for controlling print wires arranged with a gradient has already been disclosed by Hoskins (JPB 81-44461), and the device generally has a structure described hereinafter.

FIG. 22 is a block diagram of a conventional print head control unit which controls a print head having a dot arrangement shown in FIG. 21B. FIG. 23A through FIG. 23C show drive timing charts of a 24-pin wire dot head, and FIG. 23A, FIG. 23B and FIG. 23C correspond to the heads having dot patterns shown in FIG. 21A, FIG. 21B and FIG. 21C, respectively.

In FIG. 22, 127 denotes a character font read-only memory (hereinafter referred to as a character font ROM) in which data of character font have been stored, and 128 denotes a dispersion timing generating unit which generates a timing for printing data dispersion, which consists of a timer 129 which generates a clock having timings T7 and T8 as shown in FIG. 23B, a timer 130 which generates a clock having a timing of T9 and an oscillator 131 which operates the timers 129 and 130. 132 denotes a shift register unit which has the printing data read out of the character font ROM 127 delayed. 133 denotes a central processing unit (hereinafter abbreviated as a CPU), which controls the character font ROM 127, the dispersion timing generating unit 128 and the shift register unit 132, respectively, through an input-output unit (hereinafter abbreviated as an I/O unit) 134. 135 denotes 24 pieces of AND circuits, and each AND circuit obtains a logical product of printing data for 24 pins from the CPU 133 and the output of the timer 129. 136 denotes a head driver which applies a pulse signal to a head coil 137.

When a head having a dot pattern shown in FIG. 21A is controlled, it is only required to provide a timer which generates a timing T7 which determines intervals among dots composing a character and a timing T8 which determines the conduction time of a head coil driving the head pins as shown in FIG. 23A. When a head having a dot pattern shown in FIG. 21B is controlled, the drive timing is different for each pin as shown in FIG. 23B. Accordingly, not only a timer which generates the timing T7 and the timing T8, is needed but also a timer which generates a timing T9 which determines delay time for each dot in accordance with the gradient of the dot arrangement are required, and it is necessary to delay all the drive timings for 24 pins by the timing T9 each time. When a head having a dot arrangement shown in FIG. 21C is controlled, the control circuit is simplified by applying delay in drive timing to each group of 6 pins as shown in FIG. 23C.

Printing operation of the conventional printer constructed as described above will be described.

First, explanation will be made in case continuous forms are used with reference to FIG. 18. Forms are conveyed to the platen 103 from the forms conveying port 101*a* by means of the tractor feeder 104, and conveyed thereafter to a printable position in such a form as to wind round the platen 103 by means of the paper guide 108 and the paper presser plate 109. An impact force is applied to the forms through an ink ribbon (not shown) by driving print wires of the print head 102 in above-described state, thereby to perform printing. Thereafter, the forms are discharged passing above the paper separator 106 through the form conveying port 101*b* while being printed.

On the other hand, when cutforms are used, the cutforms are used in a state that the paper stand 105 is set up as shown in FIG. 19. In this case, forms are inserted into the form conveying port 101*a* while having the forms move along the upper surface of the paper stand 105. In this case, the inserted forms are inserted under the platen 103 by means of the paper separator 106. When the platen 103 is rotated thereafter in a direction indicated with an arrow mark A automatically or manually, the forms move following the rotation, but are conveyed to a printable position in such a manner as to wind round the platen 103 by means of the paper guide 108 and the paper presser plate 109, and printing and paper discharge are performed in a similar manner as the time of using continuous forms.

Furthermore, when print wires of the print head 102 are driven, the print head control unit is operated as follows.

The CPU 133 is informed of a timing W (hereafter referred to as shift data) every time a timing signal at the first pin shown in FIG. 23B falls. The CPU 133 sends printing data for 24 pins to the AND circuit 135 from the character font ROM 127 in accordance with the timing of falling of read shift data, and the logical product of each of print data for 24 pins and the output of the timer 129 is obtained in the AND circuit 135 and sent to the shift register unit 132. Further, the timer 130 receives character mode data x from the CPU 133, and sends a clock t (hereinafter called a shift clock) having a timing with T9 in FIG. 23B as a period corresponding to printing modes of those data x to the shift register unit 132. The shift register unit 132 generates driving signals for the first pin to the 24th pin shown in FIG. 23B based on output signals from the AND circuit 135 and the shift clock t and sends the driving signals to th head driver 136. The head driver 136 drives the head by applying a pulse voltage to a head coil 137 with driving signals from the shift register unit 132. The frequency of the shift clock t varies corresponding to printing modes related to variety of characters, but T8 has to be a time of the shift clock t multiplied by an integer in order to maintain the timing at T8. Accordingly, it becomes inevitably necessary to apply the shift clock t in which the frequency is increased by dividing the period T9 to the shift register unit 132. Because of such a reason, a plurality of stages of shift registers are provided in the shift register unit 132.

FIG. 24 shows a result of measurement of a level of printing noise of a conventional printer.

FIG. 24 is a graph showing a relationship between frequencies and noises in ⅓ octave analysis in case a print wire driving frequency of above-mentioned printer is assumed to be at 1,157 Hz. In the graph, e shows a result of measurement obtained when a front cover 107 is opened, and f shows a result of measurement obtained when the front cover 107 is fitted. Besides, the overall value in these cases was at 67 dBA when the front cover 107 was opened and at 64 dBA when it was fitted.

As described above, in a printer having a conventional structure, the number of gates in the dispersion timing generating unit of a print head control unit for driving the print head was numerous, and the noise at the time of printing was neither suppressed sufficiently.

Incidentally, a case of selecting arrangement such as shown in FIG. 20C for the purpose of reducing the number of gates is not preferable because the effects such as reduction of printing noise and reduction in power source capacity are decreased sharply.

SUMMARY OF THE INVENTION

It is an object of the present invention to solve problems of a printer having a conventional structure so as to provide a dot matrix printer in which printing noise is suppressed sufficiently and the number of gates is small and which is able to correspond to the variation of dot matrix arrangement.

A dot matrix printer of the present invention has a construction in which respective print wires are driven at different timings within one pitch and is characterized by a structure in which a space around a print head is surrounded with a housing and sounds generated in a portion surrounded by the housing and a platen are transmitted outside through the walls thereof.

A dot matrix printer of the present invention comprises a print head control unit provided with a memory in which printing intervals among all dots and print head conduction time are stored, read out means for reading information stored in the memory, and driving means for driving a print head with the information which has been read from the memory by the read out means for correcting shifting from perpendicularity of dot rows arranged in a longitudinal direction of the print head.

According to a dot matrix printer of the present invention, the noise frequency at the time of printing with the print head becomes high because the print head is driven at a high pitch by means of a print head control unit which is constructed economically, and attenuation in a high-pitched tone compass while the noise is transmitted through the walls becomes high because the generated noise is surrounded by the casing and transmitted outside through the walls. Thus, an effect that operating sound of the printer which leaks outside becomes small is exhibited.

DESCRIPTION OF THE PREFERRED EMBODIMENTS

Figure 1:
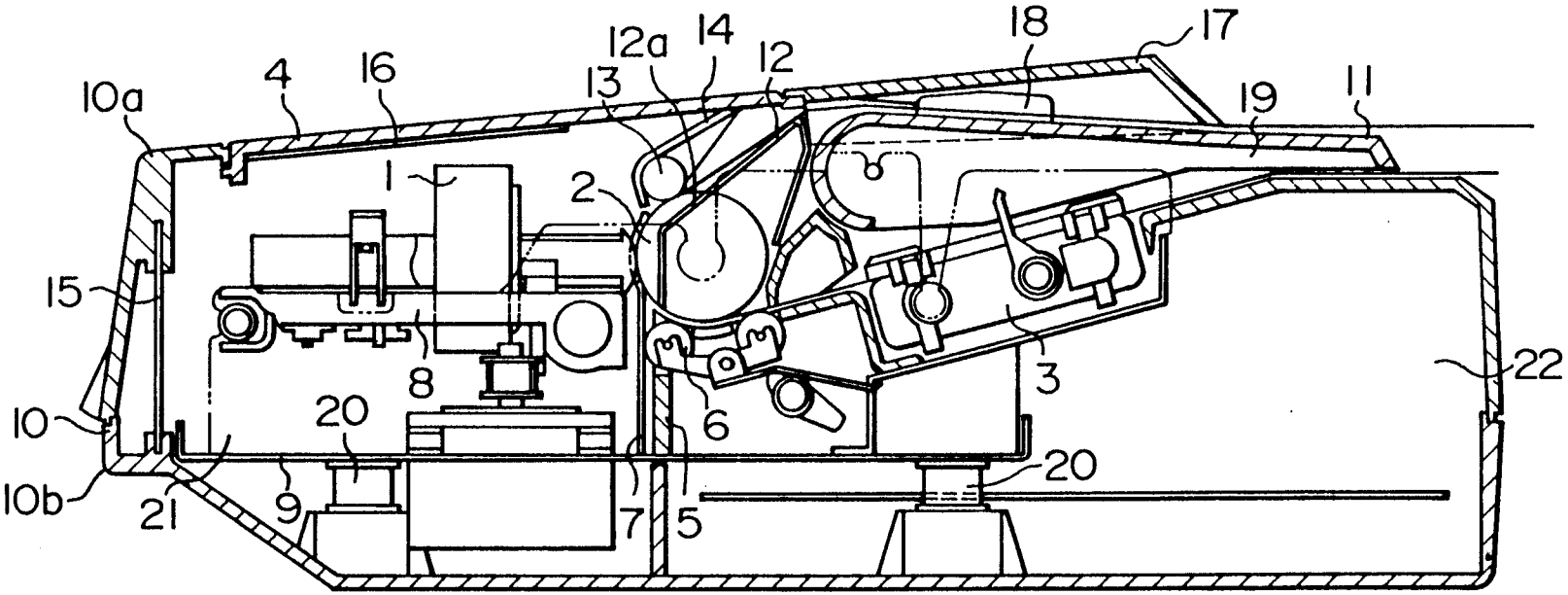
FIG. 1 is a sectional view of a printer of the present invention when continuous forms are used.
Figure 2:
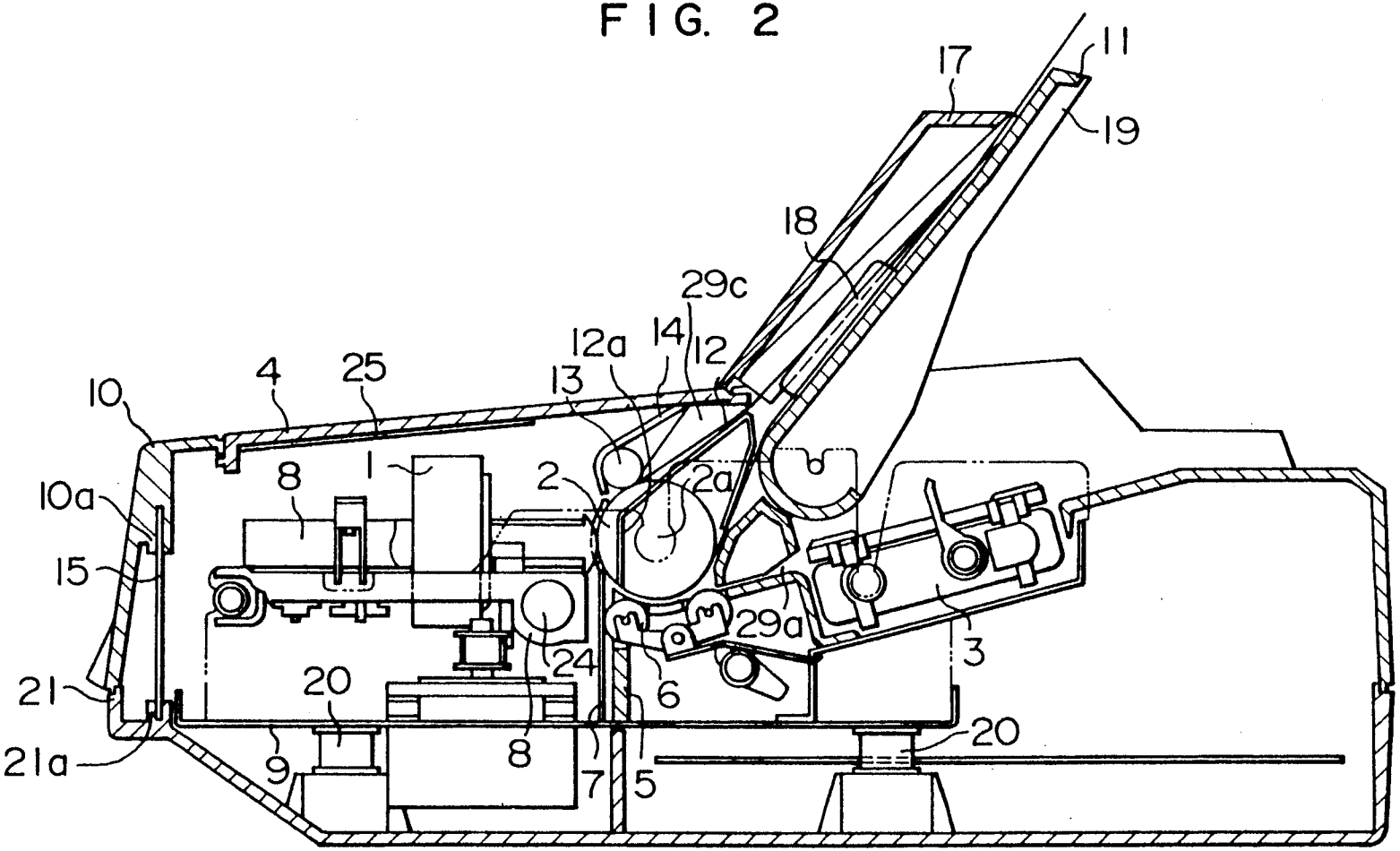
FIG. 2 is a sectional view of the printer when cut-forms are used.
Figure 3:
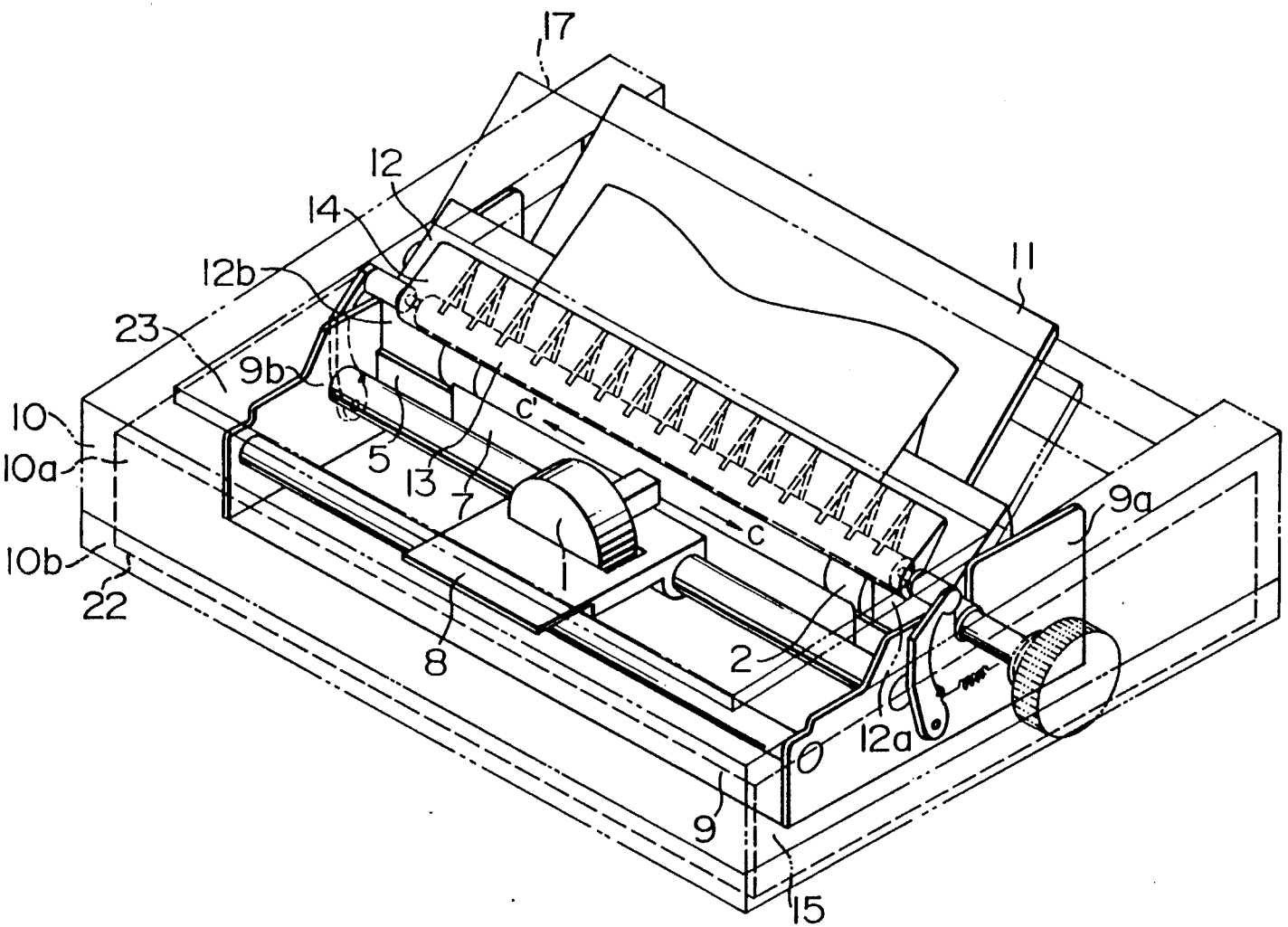
FIG. 3 is a perspective view of the printer.
Figure 4:
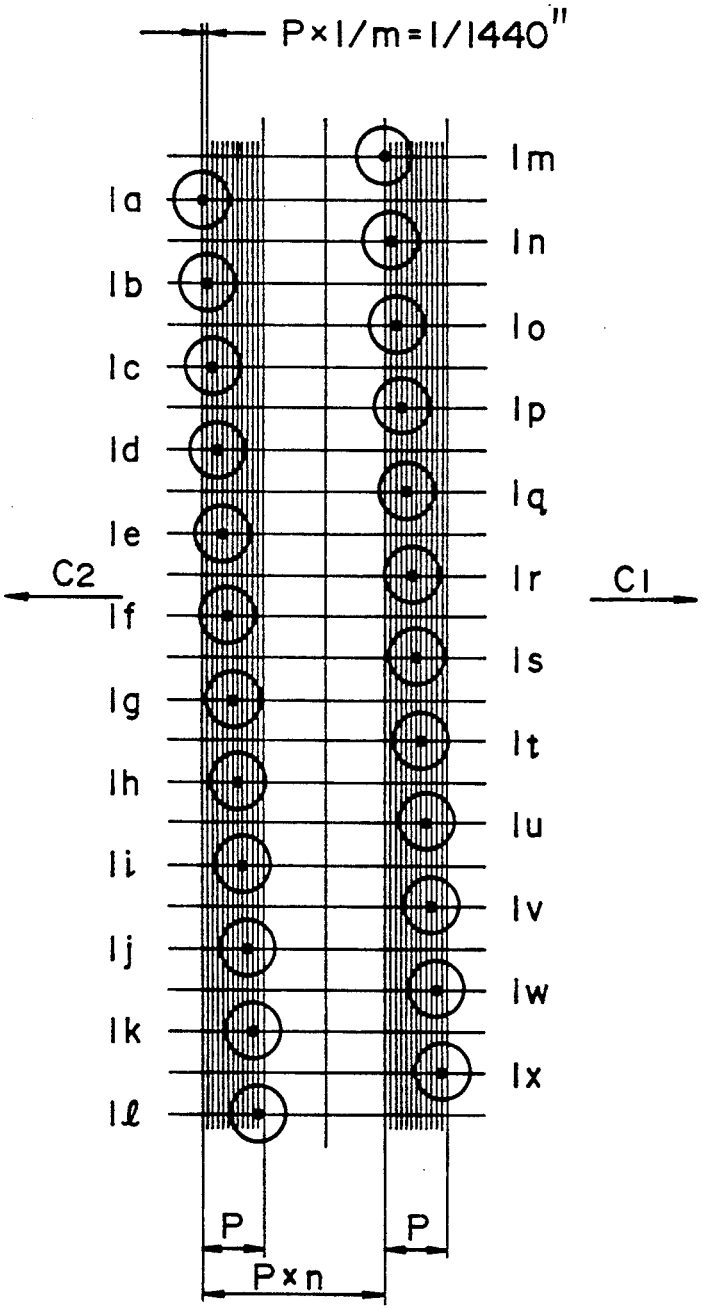
FIG. 4 is an arrangement diagram of print wires of the printer.

In FIG. 1 through FIG. 3, 2 denotes a platen, 3 denotes a tractor feeder, 4 denotes a front cover, 5 denotes a paper guide, 6 denotes a paper holder, 7 denotes a paper presser plate, 8 denotes a carriage, 24 denotes a carriage shaft, 9 denotes a chassis base made of metal on which side plates 9*a* and 9*b* are formed, 10 denotes a housing consisting of an upper housing 10*a* and a lower housing 10*b*, and 11 denotes a paper stand. Since these are the same as a prior art, explanation thereof will be omitted herein. Both end portions 12*a* and 12*b* of a paper separator 12 extend downward so as to intercept a cylindrical space produced between a small diameter portions 2*a* and 2*b* at both ends of the platen 2 and the side plates 9*a* and 9*b*. Further, a paper presser roller 13 is formed so as to be in contact with the platen 2 over the whole width thereof. 14 denotes a roller cover which covers the upper part of the paper presser roller 13 and the upper part of which is pressed by the front cover, 15 denotes a shield plate made of metal shielding between the contact portion of the upper housing 10*a* and the lower housing 10*b* and the print head 1, 16 denotes a shield plate made of metal attached to the underside of the front cover 4, 17 denotes a soundproof cover having side plates which are in contact with both sides of a form abutting portion of the paper stand 11, 18 denotes ribs provided on both sides of the form abutting portion of the paper stand, and 19 denotes ribs provided on both sides of the underside of the paper stand. 20 denotes a cylindrical rubber cushion, and the chassis base is fitted to the lower housing 10*b* through the rubber cushion 20. Print wires 1*a* to 1*x* of the print head 1 are arranged zigzag with a gradient with respect to the printing direction as shown in FIG. 4. The interval among respective print wires is at $P \times n$ (n: a natural number) with respect to a printing pitch P, and respective pins are arranged shifting by P/12 with respect to the printing direction in the rows. Further, consequential print wires in respective rows (for example, print wires 1*a* and 1*m*) are driven at the same timing.

Figure 5:
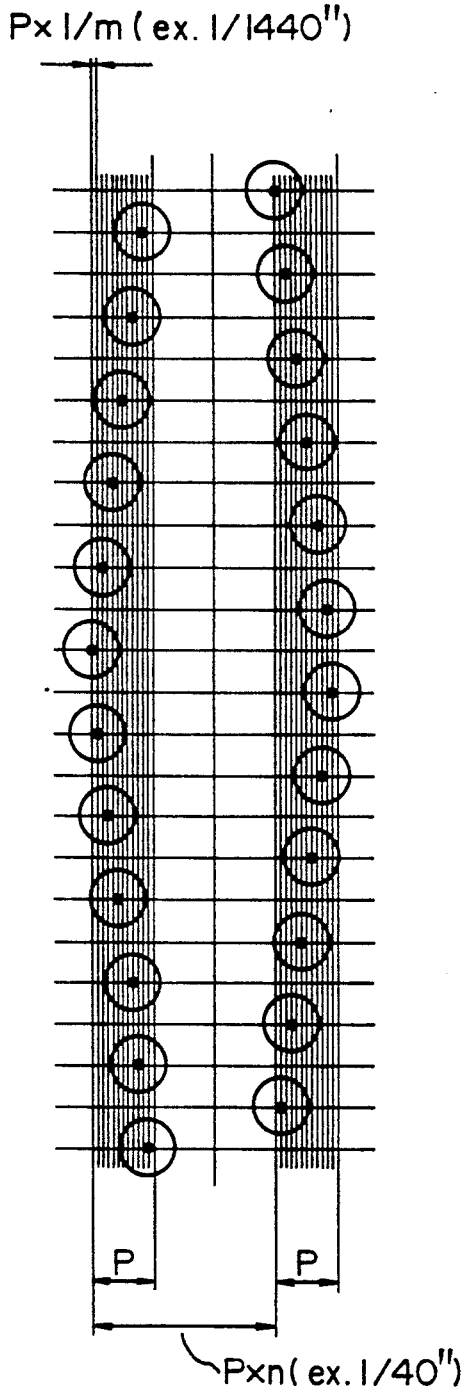
FIG. 5 is another arrangement diagram of other print wires of the printer.

Besides arranging print wires in parallel in two rows in the present invention, they may also be arranged in a rhombic form as shown in FIG. 5.

Figure 6:
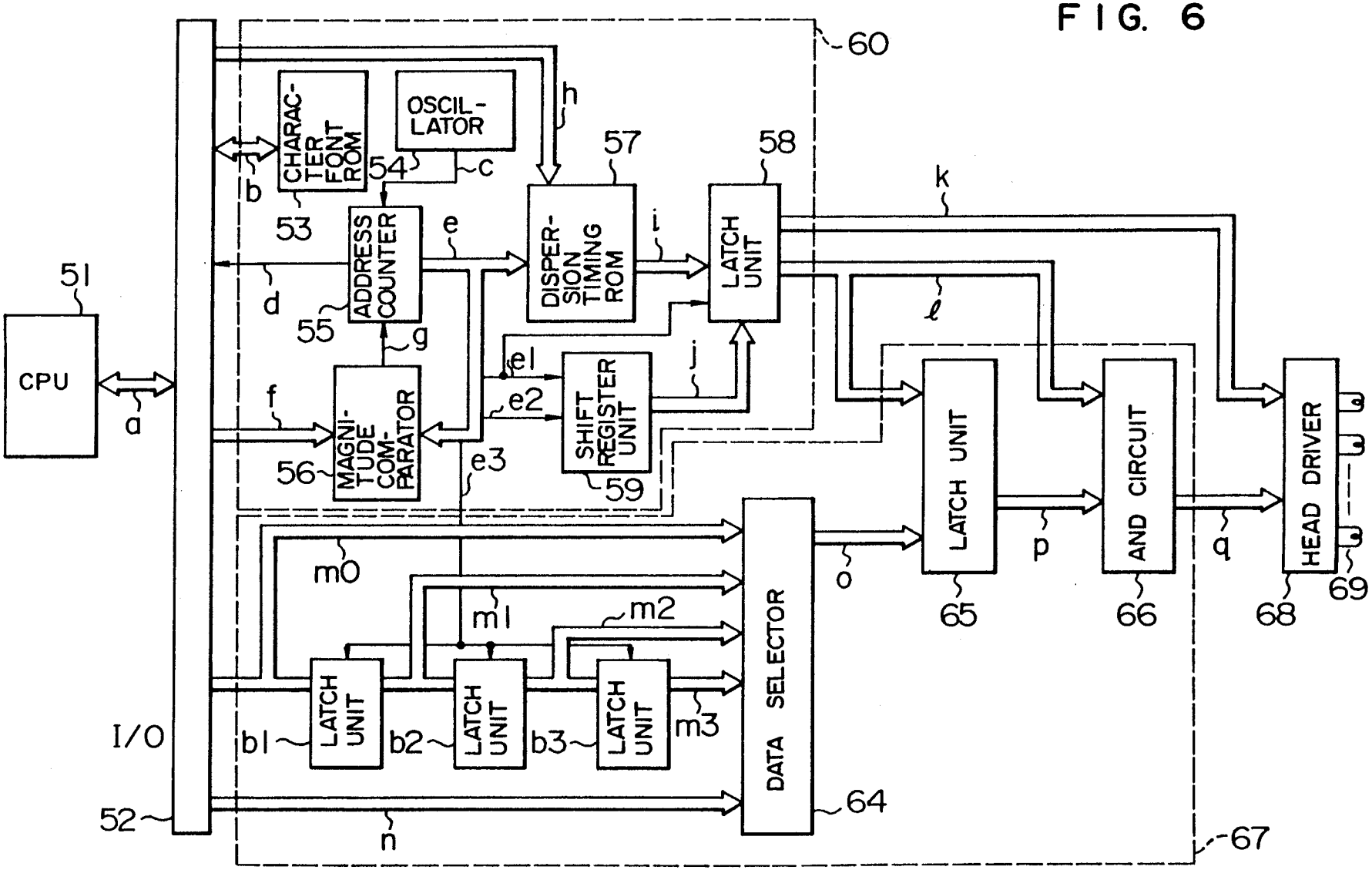
FIG. 6 is a block diagram of a drive control unit of print wires of the printer.

FIG. 6 shows a print head control unit for operating a print head in a printer of the present invention.

In FIG. 6, a numeral 51 denotes a central processing unit (hereinafter abbreviated as a CPU), 52 denotes an input-output unit (hereafter abbreviated as an I/O unit) which takes charge of interfaces among respective units, and 53 denotes a character font read-only memory (hereafter abbreviated as a character font ROM).

54 denotes an oscillator and 55 denotes an address counter which is driven by a basic clock c generated from the oscillator 54. 56 denotes a magnitude comparator, which compares printing mode data f which changes over grades of characters from the CPU 51 with the output e of the address counter 55 and outputs a counter load signal g to the address counter 55. 57 denotes a dispersion timing read-only memory (hereafter abbreviated as a dispersion timing ROM) in which dispersion timings have been recorded, from which dispersion timings are read with the output e of the address counter 55 and printing mode data h which change over grades of characters from the CPU 51 as addresses. 58 denotes a latch unit, which latches the output i of the dispersion timing ROM 57, composed of flip-flops and 59 denotes a shift register unit which outputs a latch clock j to the latch unit 58 based on outputs e1 and e2 of the address counter 55, and a dispersion timing generating unit 60, which generates the timing for printing data dispersion is constructed of these units.

61, 62 and 63 denote latch units composed of flip-flops which output data m1 obtained by having printing data m0 from the CPU 51 delayed by one data period of one dot row portion by the output e3 of an address counter 65, data m2 obtained by having the data m1 delayed by one data period, and data m3 obtained by having the data m2 delayed by one data period, respectively. 64 denotes a data selector which selects data m1, m2 and m3 by means of a select signal n from the CPU 51, 65 denotes a latch unit composed of flip-flops receiving the data m0 and the output 0 of the data selector 64 as input data and the output l of the dispersion timing generating unit as a latch clock, 66 denotes an AND circuit which obtains a logical product of the output l of the dispersion timing generating unit 60 and the output p of the latch unit 65 and outputs a head drive signal g, and an FIFO unit 67 is composed of these units.

A head driver 68 drives a head 69 with an output k of the latch unit and an output g of the AND circuit.

Figure 7A:
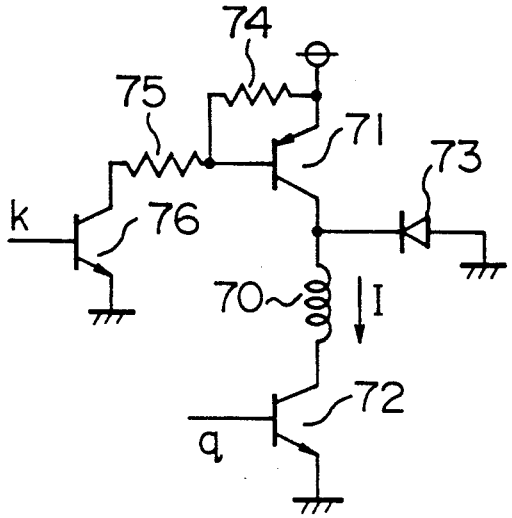
FIG. 7A is a circuit diagram of one head driver pin of the control means.
Figure 7B:
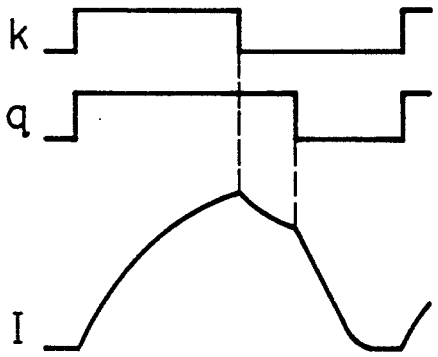
FIG. 7B is a timing chart of signals driving the head driver.

FIG. 7A is a circuit diagram of one pin's portion of the head driver 68, and FIG. 7B is a timing chart of signals which drive the head driver 68. In FIG. 7A, transistors 71 and 72 and a diode 73 are connected at both ends of a head coil 70, and a power source is connected with the emitter of the transistor 71 and the base thereof is connected with a collector of a transistor 76 through a resistor 75. The emitter of the transistor 72 connected with ground.

The operation of a print head control unit constructed as described above will be described. Here, the pattern of the print head 1 is exactly the same as described previously. Hence, the description thereof will be omitted.

Figure 8:
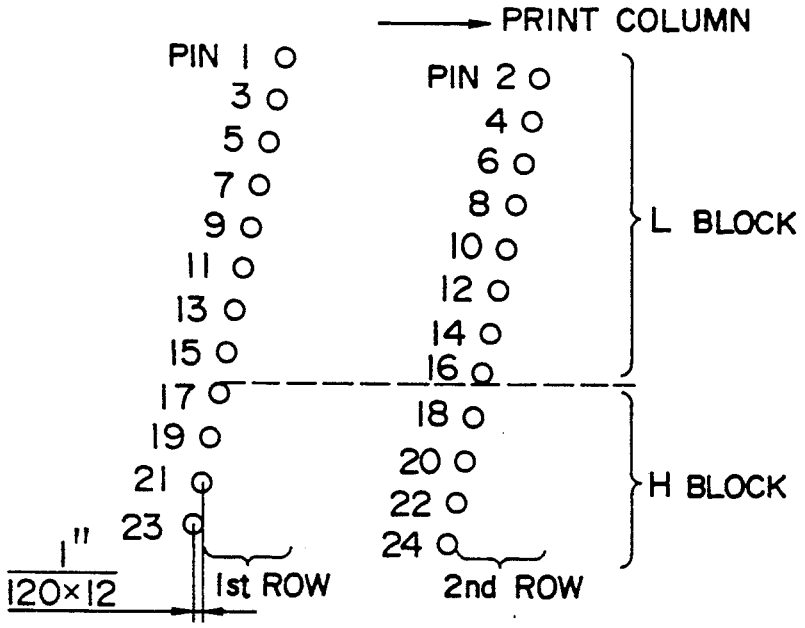
FIG. 8 is a head pattern diagram of a head controlled by a print head control unit of the present invention.

Besides, as shown in FIG. 8, lower 8 pins are arranged in an L block and higher 4 pins are arranged in an H block for the purpose of easy control with respect to 12 pins in the same row of print wires.

Figure 9B:
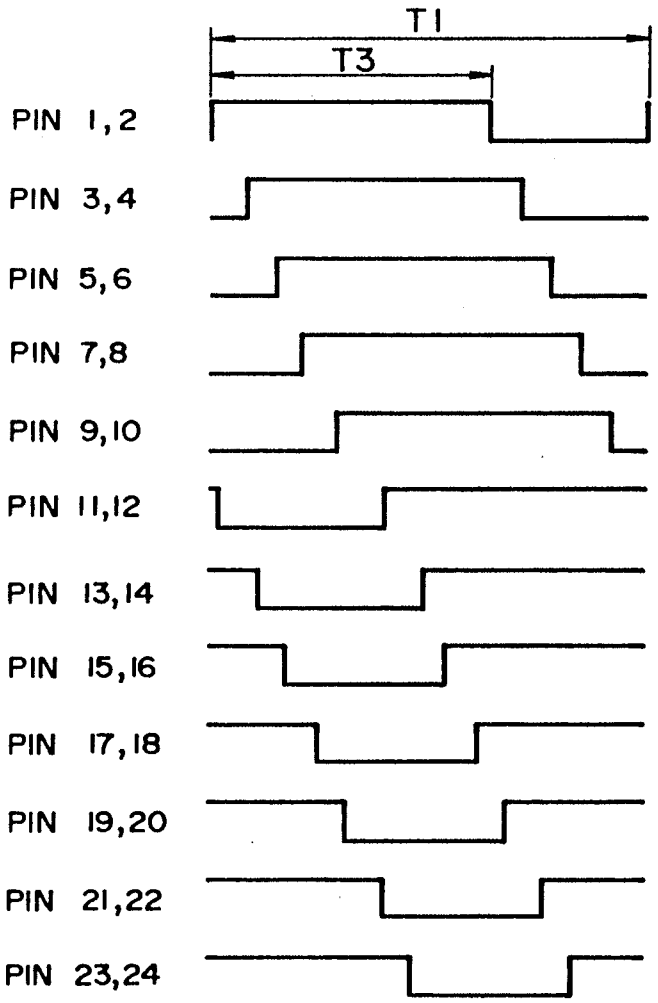
FIG. 9B is a timing chart showing timings for 24 pins of an output signal l of the dispersion timing generating portion.
Figure 9A:
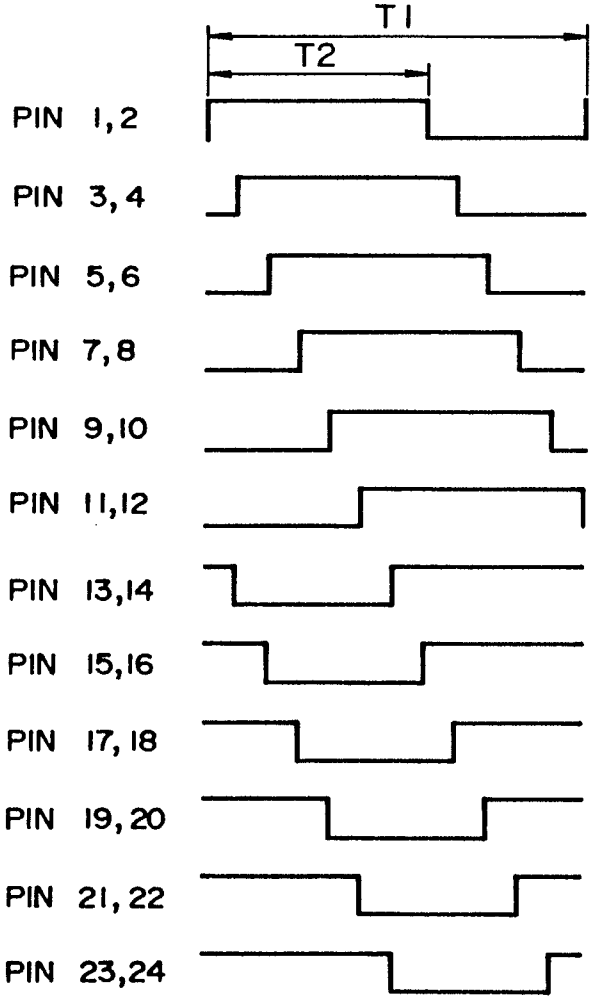
FIG. 9A is a timing chart showing timings for 24 pins of an output signal k of a dispersion timing generating portion.

FIG. 9A is a timing chart showing the timing for the 24-pin portion of the output signal k of the dispersion timing generating unit 60, and FIG. 9B is a timing chart showing the timings for the 24-pin portion of the output signal l of the dispersion timing generating unit 60. $T_1$ shows a basic cycle for printing one dot, $T_2$ shows ON time of the transistor 71 in FIG. 7A, and $T_3$ shows ON time of the transistor 72. Signals of 24 types of basic cycles in total corresponding to respective pins and transistors have been written in advance in the dispersion timing ROM 57, and are read out with the address generated by the address counter 55.

Figure 10:
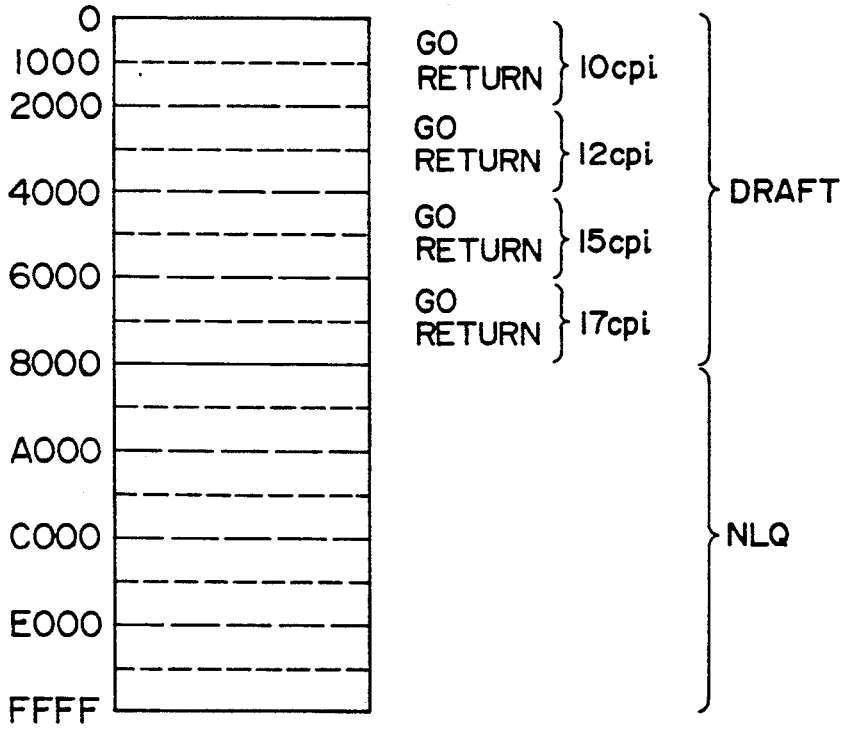
FIG. 10 is an address map diagram of a dispersion timing ROM of the control means.

FIG. 10 is an address map of the dispersion timing ROM 57. Dispersion timing data are written in hexadecimal digits up to an address FFFF in total for every 1,000 addresses. Corresponding to each of 16 types in total, that is, 2 types of draft and Near Letter Quality (NLQ) for character font of a printer, 4 types of 10, 12, 15 and 17 cpi for the number of characters per inch, and 2 types of forward direction (hereafter abbreviated as GO) and opposite direction (hereafter abbreviated as RETURN) for the printing direction of the head. Selection of these printing mode is made by a mode data signal h. $T_1$ shown in FIG. 9A and FIG. 9B has a different length depending on respective printing modes, but a magnitude comparator 56 loads the address counter 55 to all zero after the lapse of the time $T_1$ conforming to respective printing modes. $T_1$ is set to 1,024 $\mu$S at the maximum.

Figure 11:
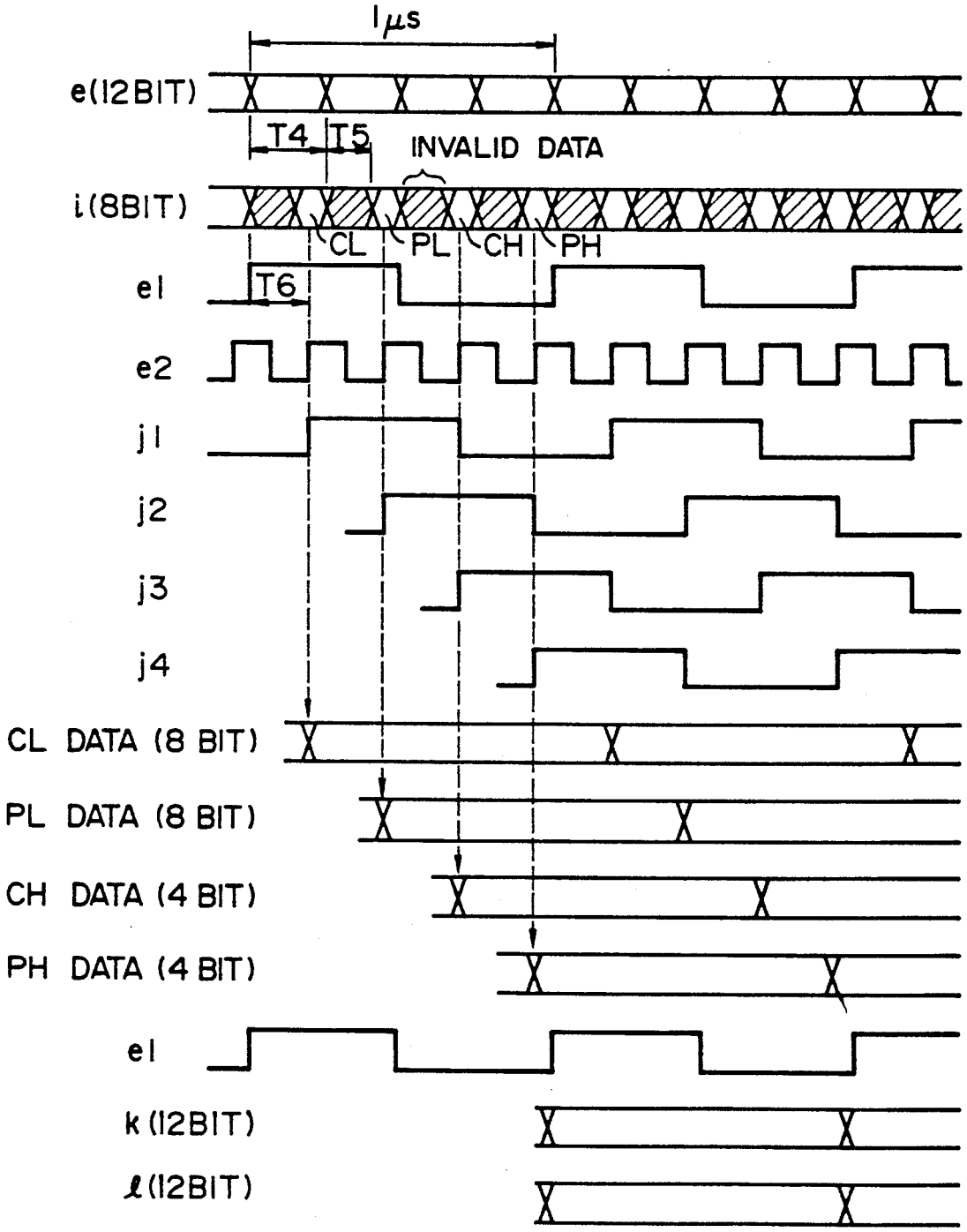
FIG. 11 is a timing chart showing output latch timings of the dispersion timing ROM of the control means.

FIG. 11 is a timing chart showing the output latch timings of the dispersion timing ROM 57. A switching time $T_4$ of the address e is at 250 nS, and;

data of lower 8 bits of a signal (hereafter abbreviated as CL data) which put the transistor 72 ON, data of lower 8 bits of a signal (hereafter abbreviated as PL data) which put the transistor 71 ON, data of upper 4 bits of a signal (hereafter abbreviated as CH data) which put the transistor 72 ON, and data of upper 4 bits of a signal (hereafter abbreviated as PH data) which put the transistor 71 0N are outputted consecutively from the dispersion timing ROM 57 by the address e during the period of 1 $\mu$S. Since $T_5$ is an output delay time at approximately 150 nS of the dispersion timing ROM 57, a timing $T_6$ of latching CL, PL, CH and PH data is set to 200 nS so that $T_6$ shows $T_5 < T_6 < T_4$. Latch clocks j1, j2, j3 and j4 are produced with e1 and e2 outputted from the address counter 55 in the shift register 59. In the latch unit 58, CL data, PL data, CH data and PH data of the output i of the dispersion timing ROM 57 are latched by latch clocks j1, j2, j3 and j4 and these data are latched further at the rise timing of e1, thereby to generate a dispersion timing signal k1 in 12 bits. These outputs have an accuracy of 1 $\mu$S.

Figure 12:
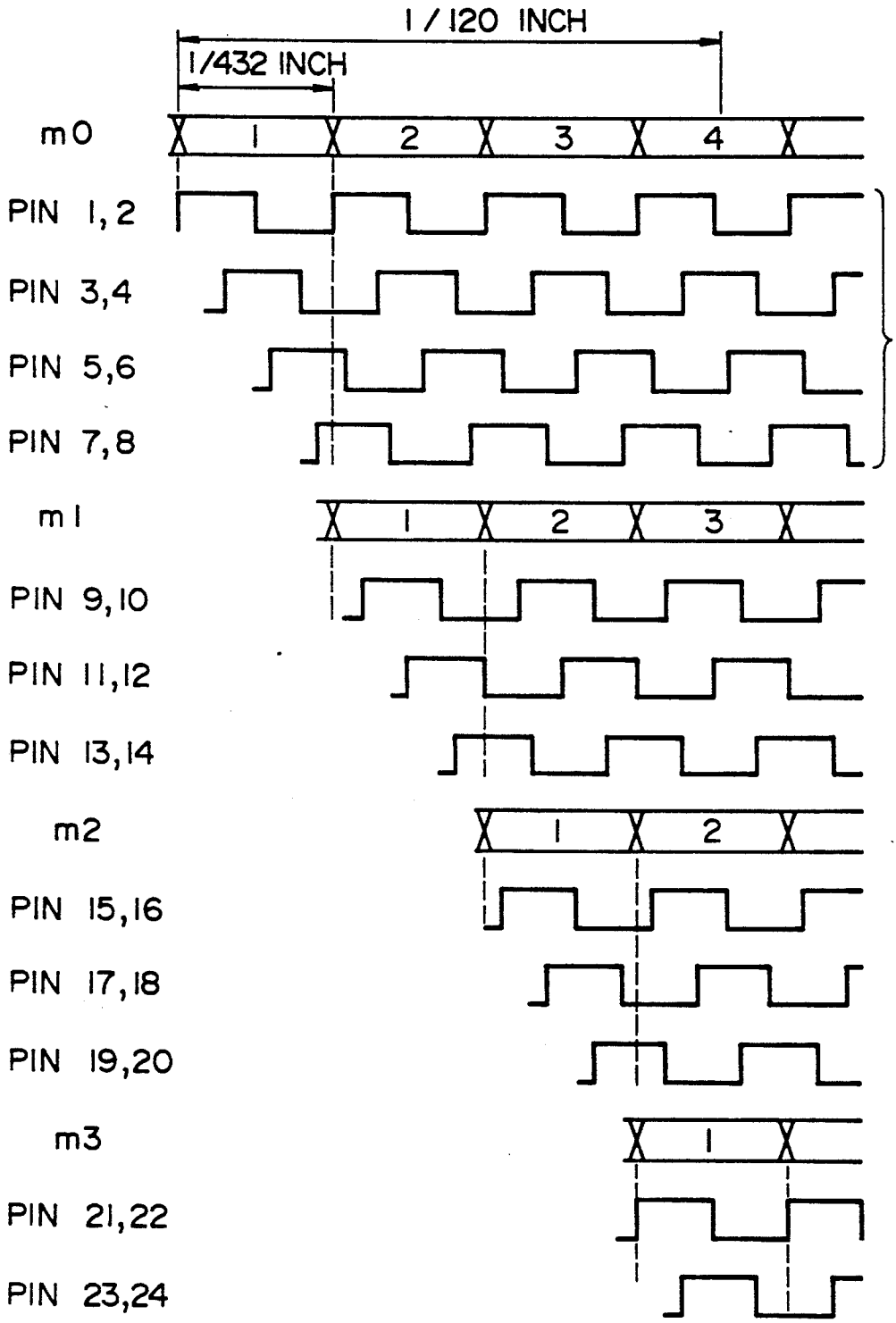
FIG. 12 is a timing chart of an FIFO unit of the control means.
Figure 14:
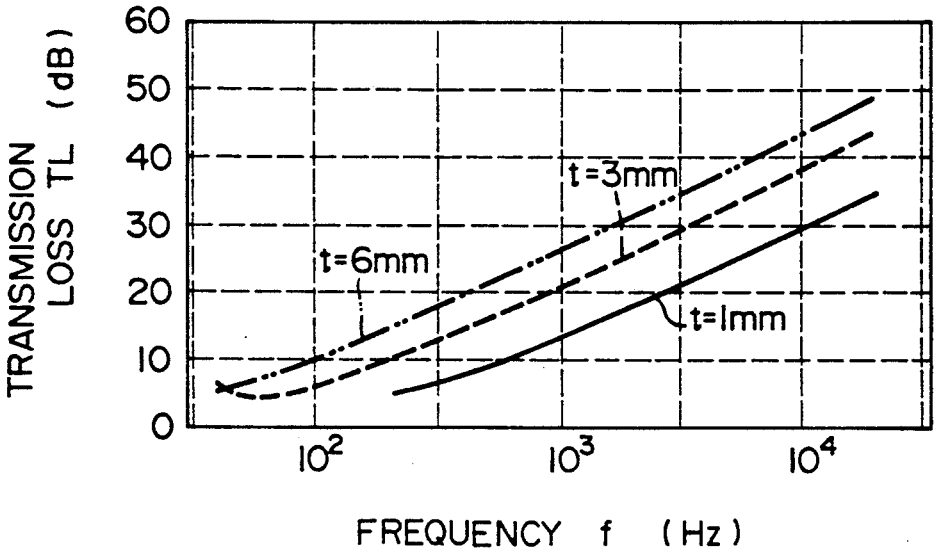
FIG. 14 is a graph showing a relationship between transmission loss and frequency.

FIG. 12 is a timing chart of the FIFO unit. There are eight types of printing modes in total, draft/NLQ, and 10, 12, 15 and 17 cpi, and some of these types have print dot interval of 1/432 inch such as shown in FIG. 12. Since the dot pattern interval of the head is 1/120 inch, the dispersion timing dividing 1/120 inch into 12 sections extends over four data portions of printing data m0 having printing dot interval at 1/432 inch from the CPU 51. In order to correspond to such printing modes, these data that are delayed by 1 datum, 2 data and 3 data period, respectively, such as m1, m2 and m3 for the data m0 are obtained first and input into the data selector 64, so that data 0 selected by a select signal n from the CPU 51 are obtained. In the case of FIG. 12, respective printing data for pins 1 to 8, pins 9 to 14, pins 15 to 20, and pins 21 to 24 correspond to m0, m1, m2 and m3. In case the printing data interval is fixed at 1/120 inch, the data selector 64 and flip-flop groups 61, 62 and 63 are not required. For m0 and the output of the data selector 64, respective printing data of 64 pins inputted to the latch unit 65 are latched by dispersion timing signals shown in FIG. 14. Furthermore, a logical product of the latched data p of respective pins in 24 bits and the dispersion timing signal l is obtained by an AND circuit 66, thereby to obtain a head drive signal g.

As shown in FIG. 7A and FIG. 7B, when both k and g are made high, the transistors 71 and 72 are put ON by the drive signals k and g in the head driver 68 and an electric current I is applied to the head coil 70 and increase in accordance with a time constant. Next, when k is made low, the transistor 71 is put OFF and an electric current flows into the head coil 70 from the diode 73. Then, when g is made low, the electric current reaches zero gradually. Two-step driving system which switches both ends of the head coil is adopted for a wire dot printer which is driven by an electromagnetic force for the purpose of driving the wires at high speed and low power consumption, and the wire dot printer is driven by head drive signals of two types of timings, k and g.

In the present invention, only 1,500 gates +ROM are required by using a dispersion timing ROM, while approximately 7,000 gates required in a conventional circuit.

In a printer constructed as described above, a space on the printing side and a space in the rear thereof are separated from each other by shield plates 9*a* and 9*b* with the platen 2 as a border, a space between the upper part of the platen 2 and the front cover 4 is shielded by means of the paper presser roller 13 and the roller cover 14, and a space between the contact portion between the upper housing 10*a* and the lower housing 10*b* and the print head 1 is shielded by means of the shield plate 15, whereby the airtightness in the space on the side of the print head 1 is higher than before. As a result, the printing sound leaks outside less than before and the noise is reduced.

The difference in a soundproof effect by the sound frequency when the airtightness in the spaced on the side of the print head 1 is increased as described above will be discussed.

Figure 13:
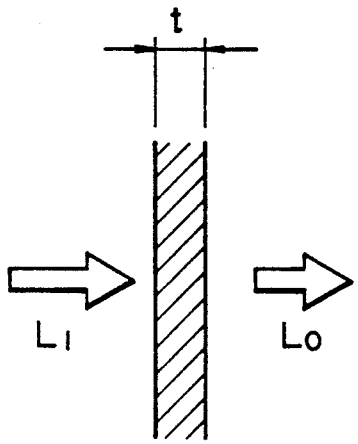
FIG. 13 is an explanatory diagram for explaining a relationship between an obstruction and sound transmission.

When airtightness is increased, most of printing sound is transmitted through some obstacles such as the housing 10, thus producing attenuation of printing sound by the obstacles. As shown in FIG. 13, such attenuation is expressed with a transmission loss $T_L$ produced when a sound passes through an obstacle having the thickness of t, as follows.

$$\begin{aligned} o\,T_L &= L_1 - L_0 \\ &= T_{L2} - 10\log(0.23 \times T_{L2}) \\ o\,T_{L2} &= 20\log(f \times m) - 42 \end{aligned} \quad (1)$$

$L_1$: sound pressure before passing through the obstacle
$L_0$: sound pressure after passing through the obstacle
m: surface density (Kg/m$^2$)
f: frequency (Hz)
$\rho$: density of the obstacle (Kg/m$^3$)
t: thickness of the obstacle (m)

As shown by the expression (1), the higher the density $\rho$ of the obstacle is, the larger the transmission loss $T_L$ becomes. Further, the variation of the transmission loss at the frequencies from 20 to 20,000 (Hz) at the density $\rho$ of the obstacle of $1.28 \times 10^{-6}$ (Kg/m$^3$) is shown with a graph of frequency f versus transmission loss $T_L$ shown in FIG. 14 in cases of the thickness t of the obstacle at $1\times10^{-3}$, $3\times10^{-3}$ and $6\times10^{-3}$ (m), respectively. It is understood that the higher the frequency becomes, the larger the transmission loss becomes irrespective of the thickness of the obstacle as shown in FIG. 13.

It is described how to drive print wires 1*a* to 1*x* of the print head 1 taking what is called black solid printing in which all the print wires are driven at every pitch as an example.

When it is assumed that the time required for the print head 1 to move by one pitch is T, printing result same as that in the past is obtained by that pins in each row perform printing twelve times while shifting the timing by the time T/12. As a result, two pins and more will never be driven at the same time at the maximum in the present embodiment as compared with a conventional print head in which print wires are driven at 24 pins at the maximum simultaneously. Therefore, the printing sound is reduced sharply.

Figure 15:
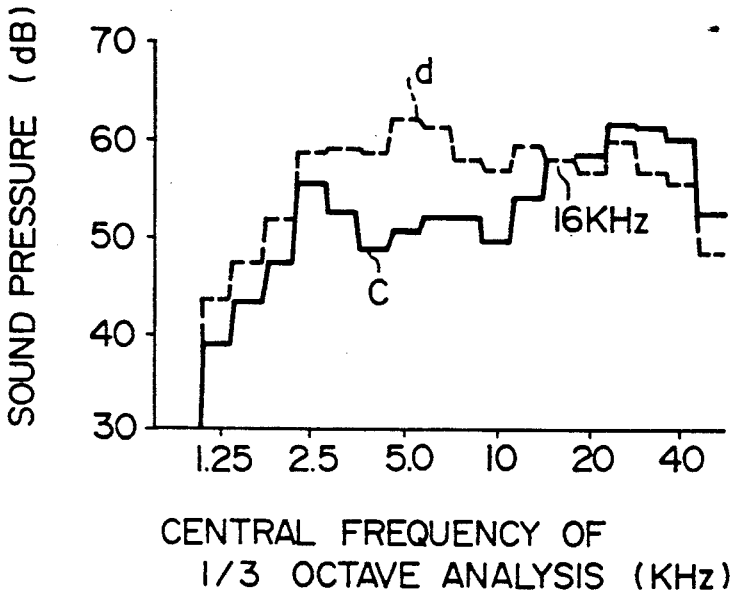
FIG. 15 is a graph obtained by ⅓ octave analysis of printing sounds of the print head of the printer and a conventional printer.

Here, when it is assumed that the oscillation frequency of a conventional print head in black solid printing is f (=1/T), the driving frequency of each pin is f in the case of the present embodiment, but the oscillation frequency of the print head 2 itself is f×12 since it is driven twelve times during one pitch, which becomes higher as compared with a conventional print head. In case of the present embodiment, print wires are driven a plurality of times not only for black solid printing, but also for every one pitch. Accordingly, the oscillation frequency of the print head becomes high in printing on the whole. Graphs obtained as the result of ⅓ octave analysis practically made on a relationship between sound pressure and frequencies of a print head of the present embodiment and a conventional print head are shown in FIG. 15 at c and d, respectively. Besides, conditions in the present analysis are as follows.

- Pin arrangement conditions
  - Character pitch: P=1/120″
  - Number of pins in one row: m=12
  - Number of pitches between rows: n=3 (n=1, 2, 3)
  - Pitch between rows: $P_L=P\times n=1/40''$
  - Pitch between pins: $P_P=1/m=1/1440''$
- Pin driving conditions
  - Frequency: f=1157 (Hz)
  - Period: T=1/f=864 (μS)
- Print pattern
  - Digit-alphabet inclusive characters As shown in the analysis, the sound pressure values in printing in the present embodiment are smaller in a range lower than 16 KHz and bigger at frequencies higher than 16 KHz as compared with a conventional case. That is, the noise frequency of the print head becomes higher by constructing the print head 1 in a manner as the present embodiment.

With the above, according to the construction of the present embodiment, a noise the frequency of which has been made high by dispersion printing is shielded efficiently since the noise is transmitted outside through walls, thus enabling it to reduce the noise by a large margin.

Figure 16:
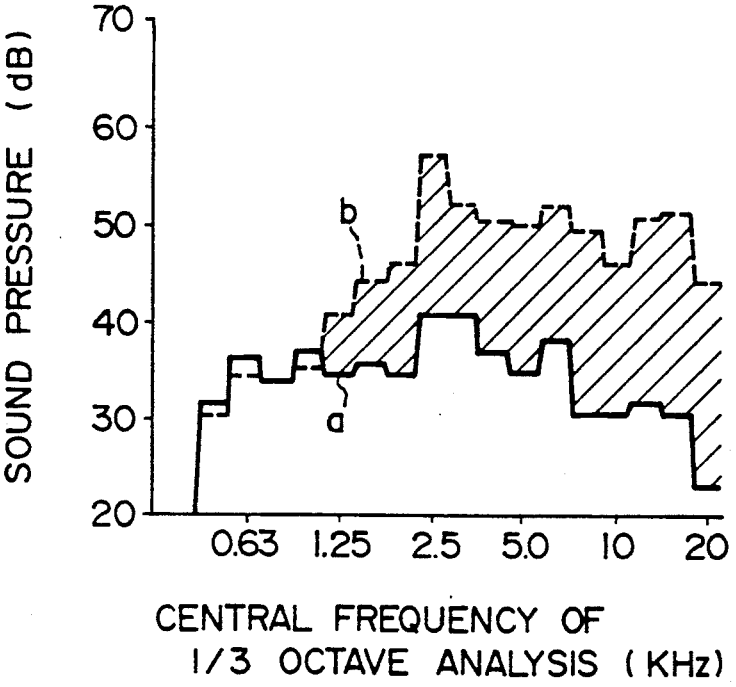
FIG. 16 is a graph applied with ⅓ octave in case the front cover 107 of the printer is removed and in case it is fitted.
Figure 24:
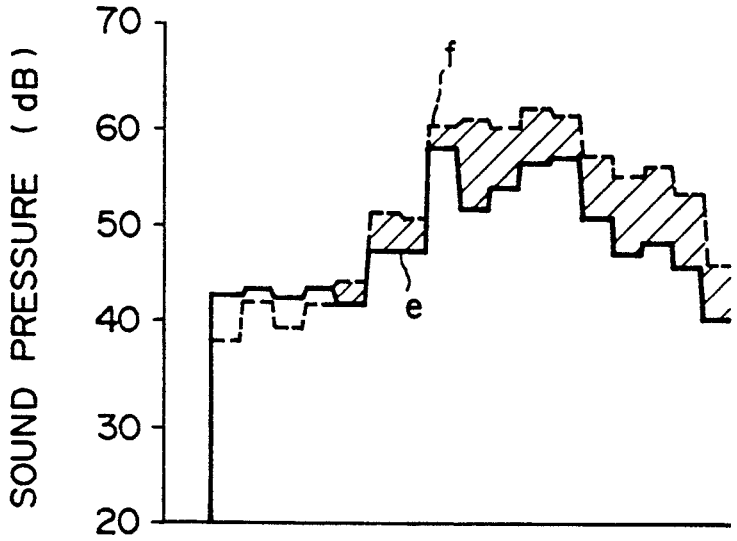
FIG. 24 PRIOR ART
FIG. 24 is a graph showing results of ⅓ octave analysis when a front cover of the printer is opened and when it is fitted.

FIG. 16 shows a graph obtained as the result of ⅓ octave analysis of the present embodiment at the time b when the front cover 4 is opened and at the time a when the front cover 4 is fitted. It is also realized that the soundproof effect has been improved by covering around a carriage shaft with a metallic plate as compared with a conventional printer shown in FIG. 24. In particular, a big soundproof effect is obtainable in a high-pitched tone compass, where the printing sound which has shifted to a higher frequency than before by means of dispersion printing is shielded effectively. Further, an overall value of the noise is at 62 dBA when the front cover is opened and at 45 dBA when it is fitted, which shows a very high soundproof effect as compared with a conventional case.

Figure 17:
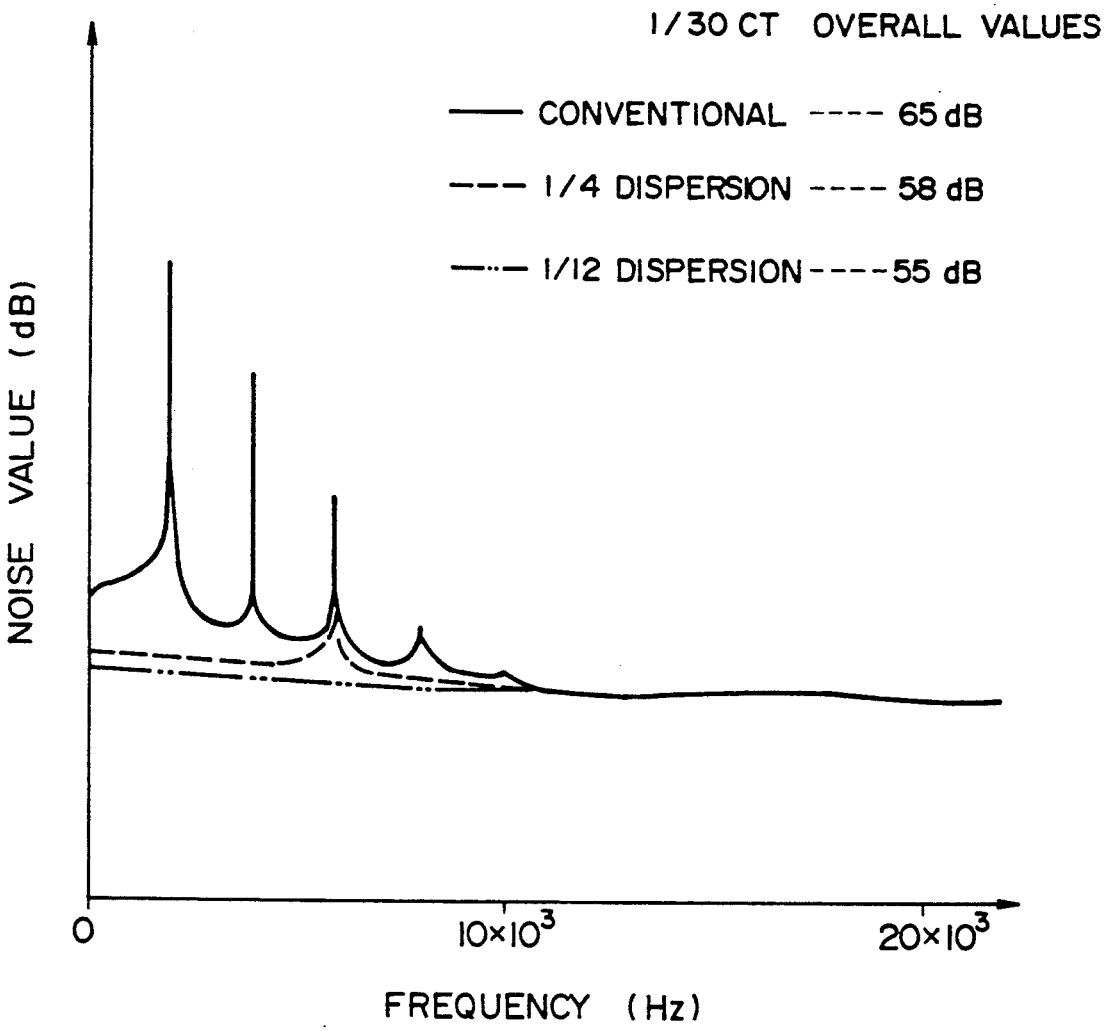
FIG. 17 is a diagram showing noise values at the time of printing.
Figure 18:
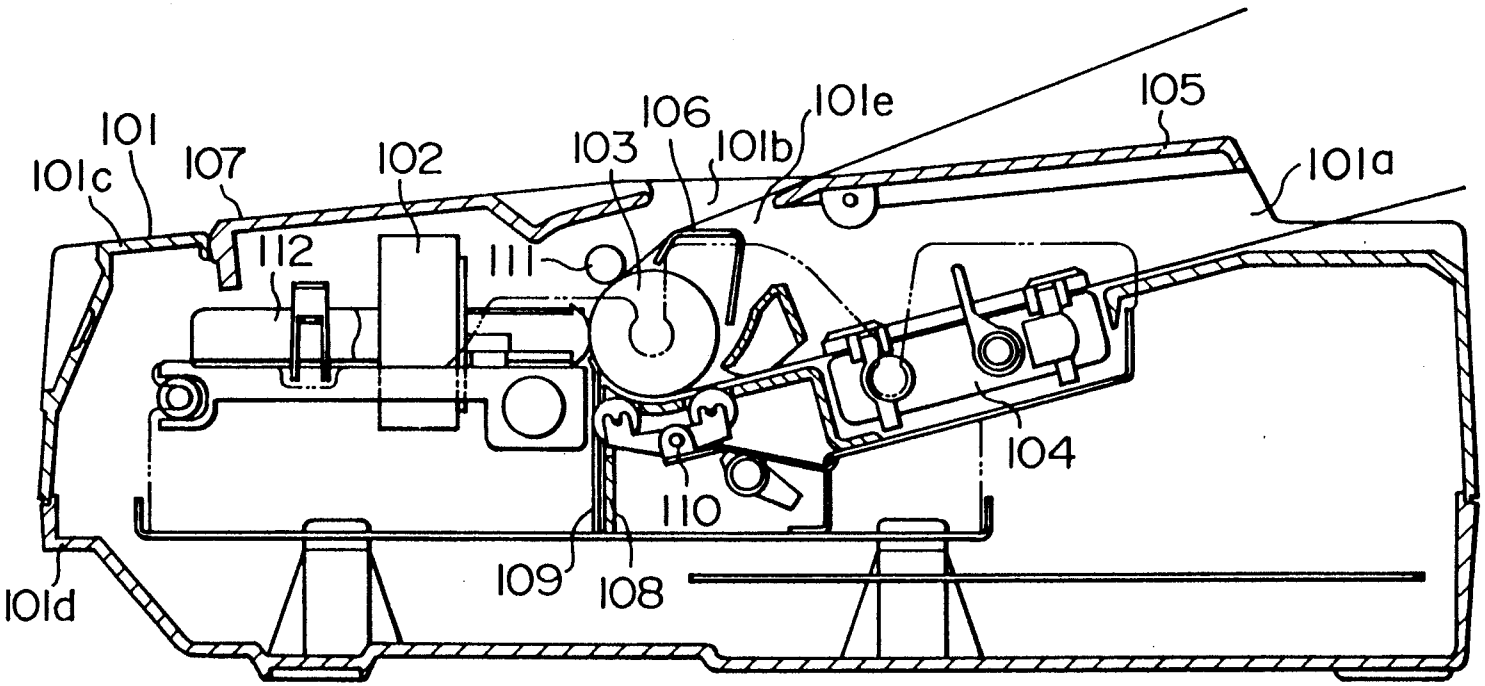
FIG. 18 PRIOR ART
FIG. 18 is a sectional view of a printer of prior art when continuous forms are used.
Figure 19:
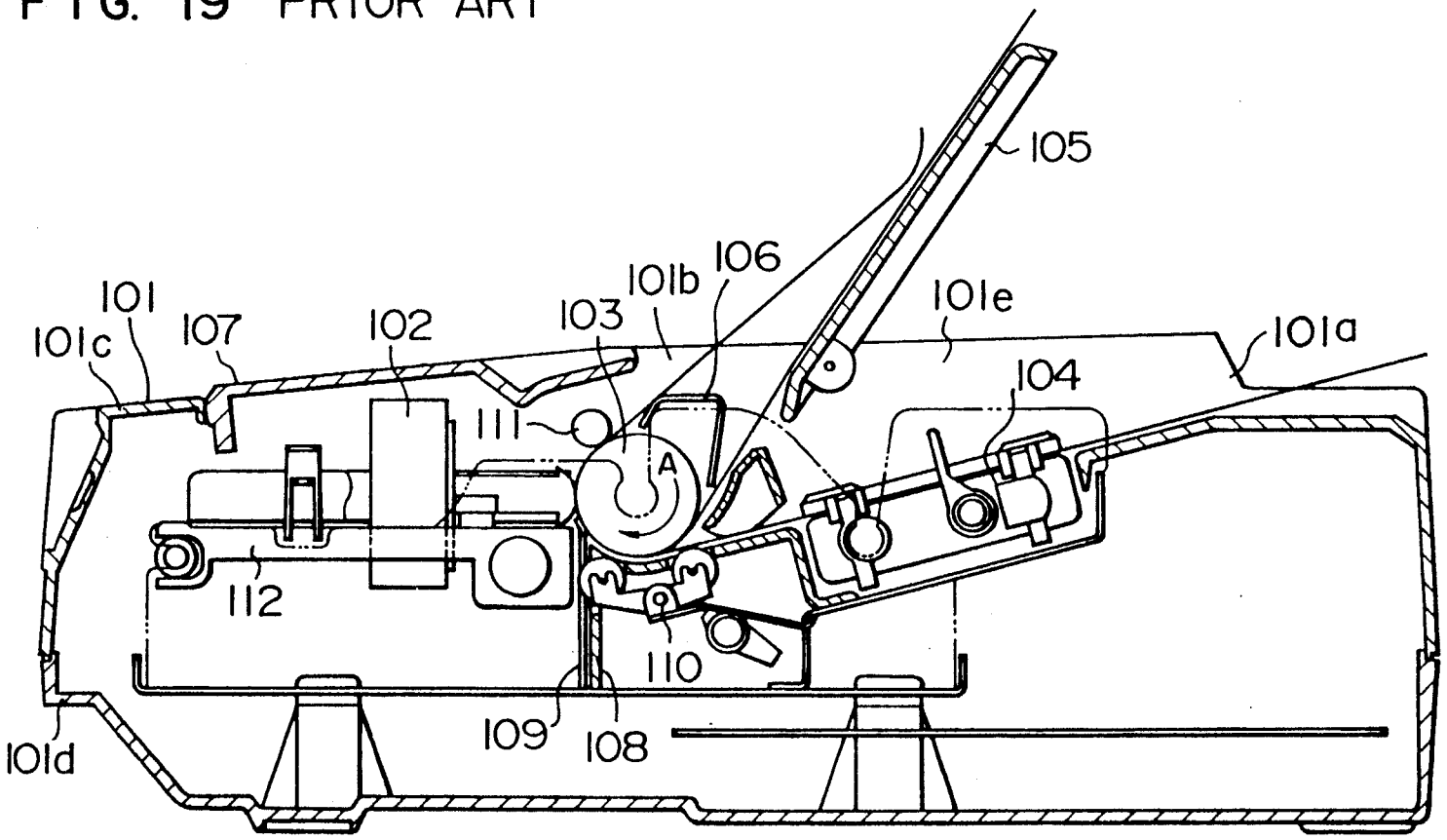
FIG. 19 PRIOR ART
FIG. 19 is a sectional view of the printer when cut-forms are used.
Figure 20:
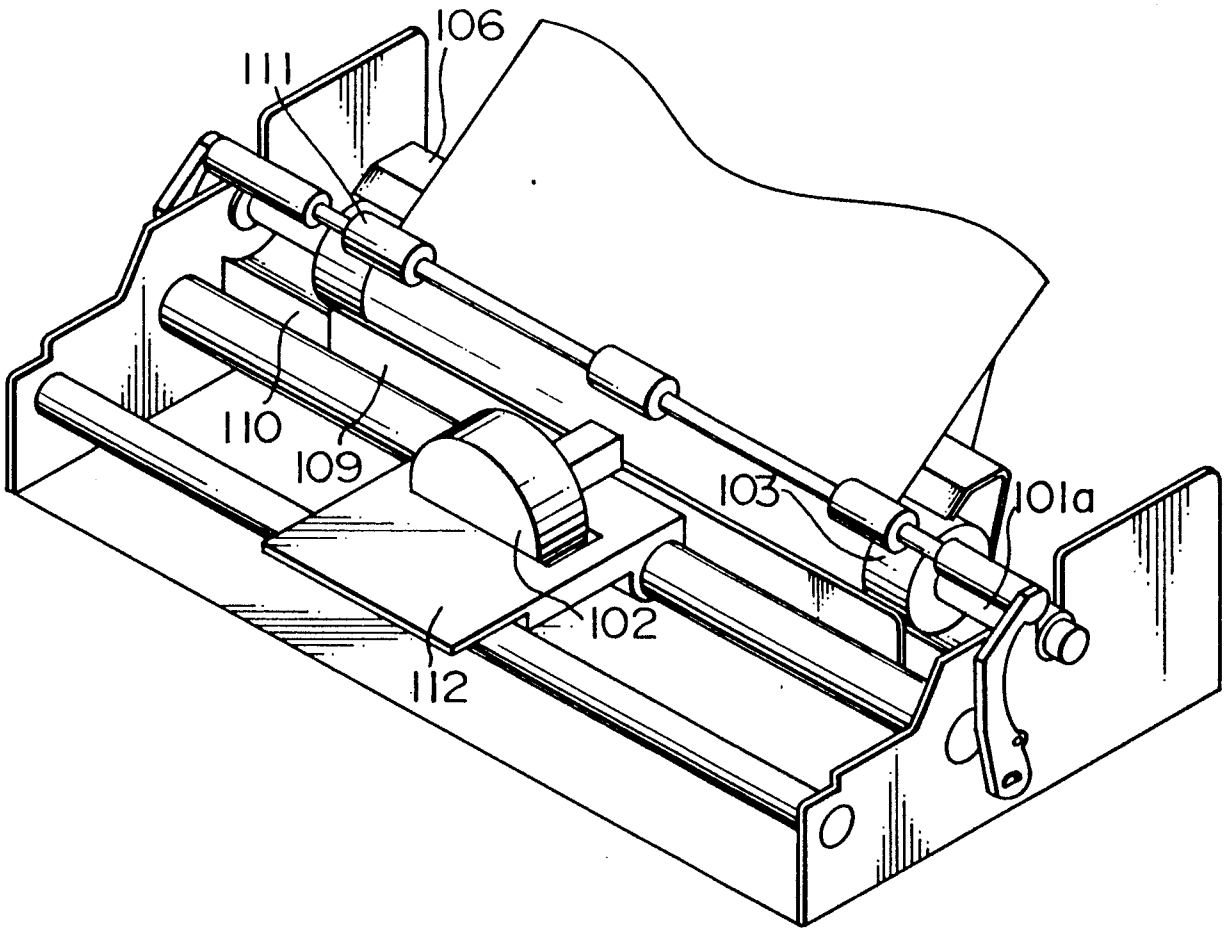
FIG. 20 PRIOR ART
FIG. 20 is a perspective view of the printer.
Figure 21A:
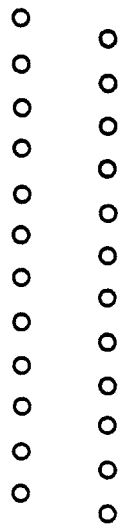
FIG. 21A PRIOR ART
FIG. 21A, FIG. 21B and FIG. 21C are arrangement diagrams of print wires of a print head of a printer of prior art.
Figure 21B:
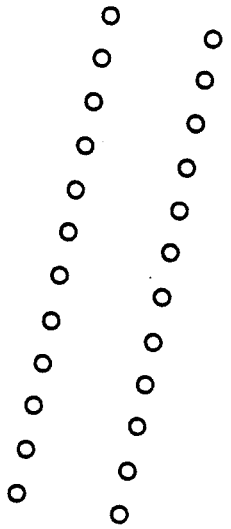
FIG. 21B PRIOR ART
Figure 21C:
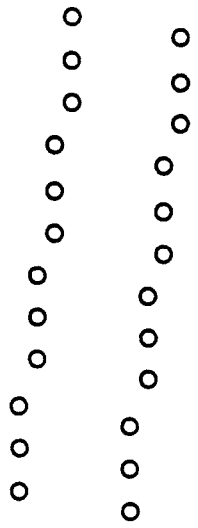
FIG. 21C PRIOR ART
Figure 22:
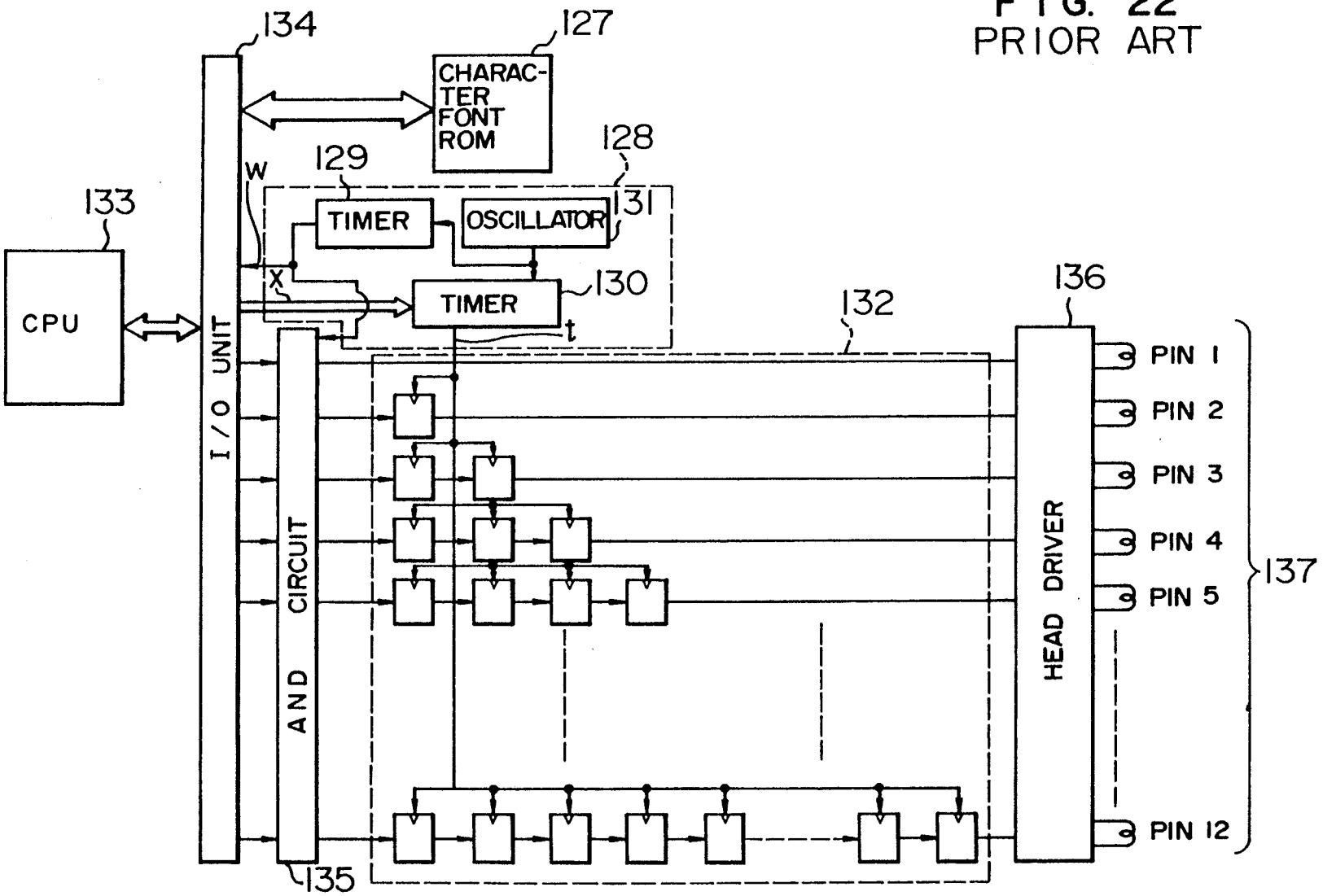
FIG. 22 PRIOR ART
FIG. 22 is a block diagram of a conventional print head control unit.
Figure 23A:
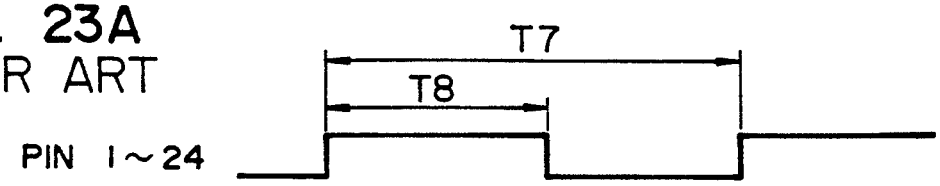
FIG. 23A PRIOR ART
FIG. 23A, FIG. 23B and FIG. 23C are drive timing charts of a 24-pin wire dot head.
Figure 23B:
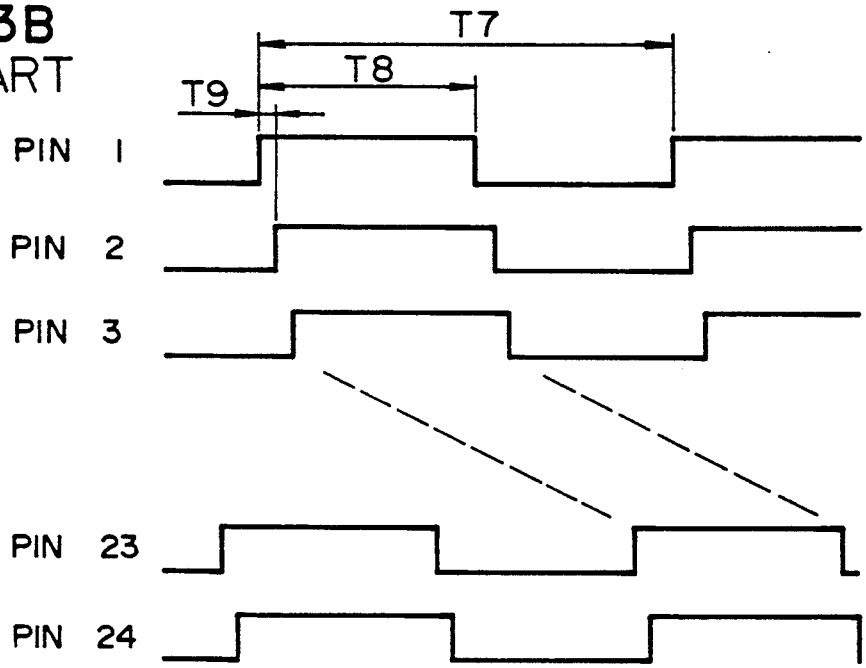
FIG. 23B PRIOR ART
Figure 23C:
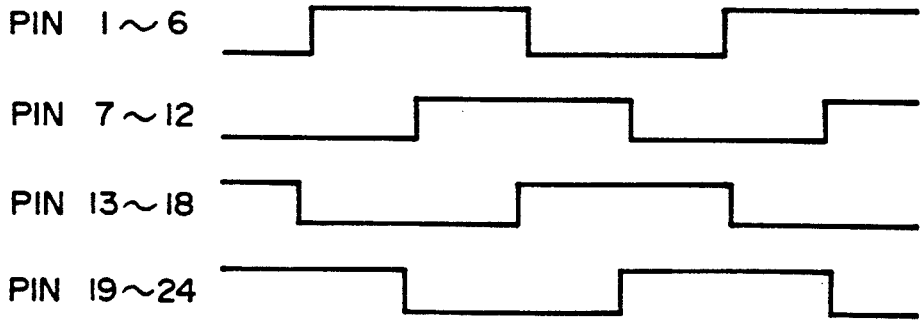
FIG. 23C PRIOR ART

FIG. 17 shows an effect of dispersion printing using a circuit of the present invention against a noise. A noise reduction effect at 7 dB with ¼ dispersion and 10 dB with ½ dispersion is obtainable by means of dispersion printing only.

As described above, the present invention has a construction that a sound from a space on the print head side with the platen as a border is transmitted outside a housing through walls and driving means which drives respective print wires of the print head at different timings within one pitch printing is provided. With this, since the printing sound becomes a high-pitched tone by driving print wires with driving means and the soundproof effect in a high-pitched tone compass is increased by airtightness means, it is possible to shield the printing sound effectively and to reduce the noise.

Furthermore, according to the present invention, there is provided a memory in which intervals of printing all the dots for correcting the gradient of dot rows arranged in a longitudinal direction of the print head and conduction time of the print head are written. Thus, it is possible to correct the gradient of dot rows arranged in a longitudinal direction of the print head without using a timer circuit. With this, it becomes possible to reduce the number of gates and to correspond to different types of units easily by varying a ROM table.

We claim:

1. A dot matrix printer comprising:

a print head which performs printing in accordance with picture image information by applying impact forces to forms;

a carriage which holds said print head; and a carriage shaft which carries said carriage;

said print head being disposed in a nearly closed space defined by:

a platen having a large diameter portion which is positioned opposite to said print head, defines a print head contact level, holds said forms and receives an impact force applied to said forms, and shafts which project at both ends of said large diameter portion;

a base member for supporting said carriage shaft and including a pair of side plates which support both projected shafts of said platen and a bottom plate which bridges both side plates;

a housing having a lower portion and an upper cover portion, wherein said lower portion is in contact with said base member, said upper cover portion covers said carriage shaft, said carriage, said print head and said platen, and said upper cover portion is formed with a form conveying port;

a paper separator comprising a wing portion which is positioned above said platen and separates a paper feed side and a paper discharge side of said platen from each other and a pair of extended portions which extend downward at each end, wherein each of said extended portions is formed so as to fill up a clearance between an end portion of the large diameter portion of said platen and the side plates of said base member; and a paper presser plate coming in contact with substantially an entire width of said platen at a position beneath said print head contact level.

2. A dot matrix printer according to claim 1, wherein said printer is of a dispersion printing type in which said print head includes a plurality of print wires arranged in at least one longitudinal row and said printer further includes a print head control unit for driving said print wires arranged in said at least one longitudinal row while shifting an impact timing for every wire so as to perform printing in accordance with picture image information, wherein said nearly closed space is further defined by:

a paper presser roller pressing onto an upper side of said platen; and a roller cover for covering said paper presser roller and extending substantially the whole width of said platen, wherein an upper part of said roller cover is in close proximity to the upper cover portion of said housing.

3. A dot matrix printer comprising:

a print head which performs printing in accordance with picture image information by applying impact forces to forms;

a carriage which holds said print head; and a carriage shaft which carries said carriage;

said print head being disposed within a nearly closed space defined by:

a platen having a large diameter portion which is positioned opposite to said print head, defines a print head contact level, holds said forms and receives an impact force applied to said forms by said print head, and shafts which project at both ends of said large diameter portion;

a base member for supporting said carriage shaft and including a pair of side plates which support both said shafts of said platen and a bottom plate which bridges both said side plates;

a housing having a lower portion and an upper cover portion, wherein said lower portion is in contact with said base member, said upper cover portion covers said carriage shaft, said carriage, said print head and said platen, and said upper cover portion is formed with a form conveying port;

a paper separator comprising a wing portion which is positioned above said platen and separates a paper feed side and a paper discharge side of said platen from each other and a pair of extended portions which extend downward at each end, wherein each of said extended portions is formed so as to fill up a clearance between an end portion of the large diameter portion of said platen and the side plates of said base member; and a paper presser plate coming in contact with substantially an entire width of said platen at a position beneath said contact level at which said print head contacts said forms on said platen, said printer being of a dispersion printing type wherein said print head has a plurality of print wires arranged in at least one longitudinal row and a print head control unit for driving said wires arranged in said at least one longitudinal row while shifting a timing for actuating every print wire so as to perform printing in accordance with said picture image information, wherein said nearly closed space is defined further by:

a paper presser roller pressing onto an upper side of said print head of said platen; and a roller cover for covering said paper presser roller and extending over substantially an entire width of said platen, wherein an upper part of said roller cover approaches the upper cover portion of said housing, wherein said print control unit comprises:

a memory for recording intervals determined so as to correct deviation of dots formed by said print wires arranged in said at least one longitudinal row from a perpendicular line;

read out means for reading out information recorded in said memory in accordance with picture image information to be printed;

control means for controlling print timings of respective dots formed by said print wires in accordance with information read by said read out means; and drive means for driving said print head in accordance with print timings of said print wires in accordance with said drive signals from said control means.

4. A dot matrix printer according to claim 3, wherein said control means comprises latch means for latching said picture image information, said control means controlling print timings for said print wires in accordance with information read by said read out means and picture image information latched by said latch means.

5. A dot matrix printer according to claim 4, wherein:

said control means is provided with drive signal output means for performing a logical arithmetic operation with picture image information latched by said latch means and information read by said read out means and outputs drive signals for driving said print head in accordance with a result of said logical arithmetic operation; and said drive means drives said print head in accordance with print timings of said print wires by said drive signals from said drive signal output means.

6. A dot matrix printer according to claim 3, wherein said memory stores plural sets of printing intervals and print head conduction time per character corresponding to printing modes determined by type of character fonts, a number of characters per unit length and the like.

* * * * *